US009717381B2

(12) United States Patent
Harman

(10) Patent No.: US 9,717,381 B2
(45) Date of Patent: Aug. 1, 2017

(54) CENTRAL VACUUM SYSTEM HOSE RETRACTOR VALVE WITH VACUUM ASSISTED HOSE LOCK AND SEAL

(71) Applicant: James Roger Harman, Gig Harbor, WA (US)

(72) Inventor: James Roger Harman, Gig Harbor, WA (US)

( * ) Notice: Subject to any disclaimer, the term of this patent is extended or adjusted under 35 U.S.C. 154(b) by 0 days.

(21) Appl. No.: 14/205,651

(22) Filed: Mar. 12, 2014

(65) Prior Publication Data

US 2014/0259509 A1 Sep. 18, 2014

Related U.S. Application Data

(60) Provisional application No. 61/851,777, filed on Mar. 13, 2013.

(51) Int. Cl.

| | |
|---|---|
| ***A47L 9/00*** | (2006.01) |
| ***A47L 5/38*** | (2006.01) |
| ***A47L 9/24*** | (2006.01) |

(52) U.S. Cl.
CPC ..... *A47L 5/38* (2013.01); *A47L 9/244* (2013.01)

(58) Field of Classification Search
CPC ..... A47L 9/0063; A47L 9/2894; A47L 9/248; A47L 9/244; A47L 5/38; A47L 5/365
See application file for complete search history.

(56) References Cited

U.S. PATENT DOCUMENTS

| | | | | |
|---|---|---|---|---|
| 3,023,447 | A | 3/1962 | Senne | |
| 3,593,363 | A | 7/1971 | Hamrick | |
| 3,682,500 | A | 8/1972 | Hamrick | |
| 4,336,427 | A | 6/1982 | Lindsay | |
| 4,688,596 | A | 8/1987 | Liebmann | |
| 4,895,528 | A | 1/1990 | Choiniere | |
| 5,430,978 | A * | 7/1995 | Kohler | 52/27 |
| 5,526,842 | A | 6/1996 | Christensen | |
| 5,578,795 | A * | 11/1996 | Ward | 174/53 |
| 6,182,327 | B1 * | 2/2001 | Gosselin | 15/315 |
| 6,459,056 | B1 | 10/2002 | Graham | |
| 7,010,829 | B2 | 3/2006 | Harman | |
| 7,624,472 | B2 * | 12/2009 | Ambrose | 15/314 |
| 7,793,384 | B1 | 9/2010 | Kerr | |
| 7,945,990 | B2 | 5/2011 | Gabric | |
| 8,479,353 | B2 | 7/2013 | Drivstuen | |
| 2001/0022009 | A1 | 9/2001 | Spearman | |
| 2007/0174991 | A1 | 8/2007 | Trotter | |
| 2012/0304414 | A1 | 12/2012 | Harman | |

* cited by examiner

*Primary Examiner* — Dung Van Nguyen
(74) *Attorney, Agent, or Firm* — Thomas E. LaGrandeur

(57) ABSTRACT

A hose retractor valve for central vacuum cleaning systems that utilize retractable suction hoses that retract into a system vacuum tubing for storage. The hose retractor valve includes a vacuum assisted hose lock and seal assembly comprising a tapered cylinder and an elastomeric cylinder which restrain the vacuum hose from being drawn into the system vacuum tubing while in use, and seals around the hose outer diameter to prevent air from passing between the inside of the system vacuum tubing and exterior of the hose at the valve assembly. The hose lock and seal assembly is self-locking and vacuum assisted, while also permitting additional hose to be extracted by pulling on the hose.

20 Claims, 7 Drawing Sheets

CENTRAL VACUUM SYSTEM HOSE RETRACTOR VALVE WITH VACUUM ASSISTED HOSE LOCK AND SEAL

This application claims the benefit of U.S. Provisional Application No. 61/851,777 filed Mar. 13, 2013.

FIELD OF THE INVENTION

The present invention relates, generally, to vacuum cleaning systems. More particularly, the invention relates to central vacuum systems of the type having retractable suction hoses and valve assemblies that permit the hose to be moved into a retractably stored position in the system vacuum tubing connecting the valve assembly to the central vacuum source.

BACKGROUND

Central vacuum cleaning systems are well known and have been available for many years. A recognized problem in the central vacuum cleaner industry is vacuum hose management. Typical vacuum hoses are 10 to 50 feet long; difficult to coil up, unwieldy to carry from location to location and bulky to store. Central vacuum cleaning systems having retractable suction hoses and hose-retracting valve assemblies, that use vacuum suction to retract the hoses back into the system type vacuum plumbing, such as U.S. Pat. No. 7,010,829 issued to Harman in 2006, provide a solution to this problem.

One aspect of such central vacuum cleaning systems having retractable suction hoses and hose-retracting valve assemblies is to provide a means to restrain the movement of the hose during use at any point along the hose's length while preventing air from passing or leaking between the inside of the vacuum tubing and the exterior of the hose. While such means have been provided, as exemplified by the mechanisms for circumferential clamping around the hose described in U.S. Pat. No. 7,010,829 and U.S. Pat. No. 8,479,353, no means have been provided previously that utilize the system vacuum to assist with restraining and sealing the vacuum hose. Accordingly, there remains a need in the art for a central vacuum system in which the vacuum is used to assist in restraining the extracted hose at a given position and sealing the hose to prevent or reduce air from passing between the inside of the vacuum tubing and the exterior of the hose.

SUMMARY OF THE INVENTION

It is a primary objective of this invention to provide central vacuum cleaning systems of the type having retractable suction hoses and valve assemblies that permit the hose to be moved into a retractably stored position in the system vacuum tubing connecting the valve assembly to the central vacuum source.

A main objective of the present invention is to provide a hose retractor valve for a central vacuum cleaning system having a retractable suction hose that retracts into a system's vacuum tubing. The hose valve comprises a valve housing having an interior. Attached to the valve housing is a connection port tube arranged to communicate with the system vacuum tubing and the interior of the housing. A hose lock and seal assembly is secured to the valve housing and connection port tube, by which the hose lock and seal assembly form part of a pathway for receiving and guiding a retractable hose that extends through the interior of the valve housing, through the hose lock and seal assembly, through the connection port tube, and into the system vacuum tubing.

The lock and seal assembly, more specifically, comprises a tapered compression cylinder having a small inner diameter that is slightly larger than the hose outer diameter and a large inner diameter that is significantly larger than the hose outer diameter, with the small inner diameter oriented toward the vacuum tubing. In addition, the lock and seal assembly has an elastomeric cylinder which encircles the hose and is positioned to slide into the tapered compression cylinder. Coupling the performance of the tapered compression cylinder and the elastomeric cylinder is a thrust mechanism engageable with the elastomeric cylinder to impose a thrusting force onto the elastomeric cylinder to slide the elastomeric cylinder into the tapered compression cylinder. As such, the thrust mechanism is moveable from a first unlocked non-compressing position to a second locked compressing position where the elastomeric cylinder is pushed into the tapered compression cylinder to cause the elastomeric cylinder to compress inward around the hose to form a seal around the hose.

Another objective of this invention is to provide an improved vacuum cleaning system whereby the hose-retracting valve assembly is provided with a chuck and collet assembly to securely grip the extended vacuum hose at any point along its length. The chuck and collet assembly have several functions. One is to restrain the hose from being drawn by the vacuum into the system vacuum tubing allowing the user free movement of the portion of the hose extending beyond the housing. Another is to provide a seal around the hose out diameter preventing air from passing between the inside of the system vacuum tubing and exterior of the hose at the valve assembly.

Another objective of this invention is to allow the hose retractor assembly or valve to be mounted overhead at or above industry standard head height clearance. For example, one accepted industry standard head height clearance is 6'3'. The vacuum seal and hose lock is opened by pulling on an actuator to an unsealed and unlocked position, which preferably is also a latched position. The actuator is unlatched by pushing on it. The seal and lock are returned by a spring to the locked and sealed position.

Another objective of this invention is to provide a means whereby the chuck and collet utilize the system vacuum to assist in sealing and locking the hose and to be self-locking. The greater the suction force on the hose the tighter the chuck and collet grip and seal the hose.

Another objective of this invention is to allow the operator to unlock the chuck and collet and further extend the hose just by pulling on the hose. As soon as the operator stops pulling on the hose, the chuck, collet, return spring and system vacuum relock and reseal the hose. Another objective of this invention is to provide a latch so the chuck and collet can be latched in the unlocked position for ease of hose extraction and to minimize wear on the lock and seal mechanism.

Briefly stated, this improved vacuum system has been achieved by providing a chuck and collet assembly to restrain the hose from being drawn into the system vacuum tubing while in use, to seal around the hose OD preventing air from passing between the inside of the system vacuum tubing and exterior of the hose at the valve assembly, to allow the hose lock and seal mechanism to be operated when the valve is mounted overhead by pulling and pushing an actuator, to make the chuck and collet self-locking and to be vacuum assisted, to permit additional hose to be extracted simply by pulling on the hose.

Some of the objectives of the invention having been stated, other objectives will appear as the description proceeds when taken in connection with the accompanying drawings.

DETAILED DESCRIPTION OF THE PREFERRED EMBODIMENTS

System Description

Figure 1:
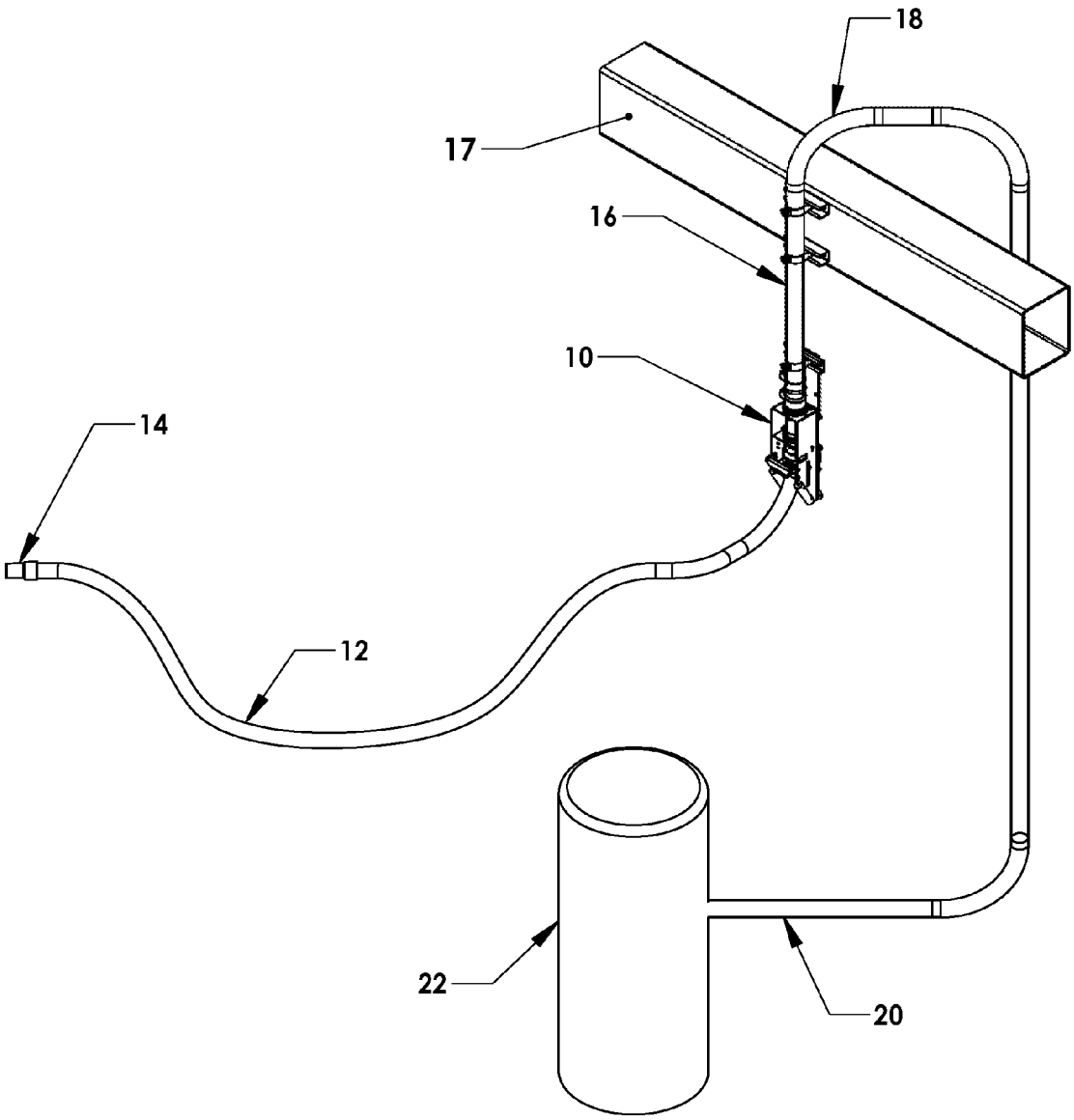
FIG. 1 is a schematic perspective view of one embodiment of the improved vacuum cleaning system wherein the central vacuum source is connected via a system vacuum tube to one or more valve assemblies known in the industry as a "valve" that provide for a vacuum hose to be moved into a retractably stored position in the system vacuum tubing, and showing the hose restrained midway along its length at its valve assembly.

The central vacuum system 8 shown in FIG. 1 consists of vacuum hose retractor valve 10 which is mounted on system vacuum tubing 16. Valve 10 is designed to mount on and be supported only by the system vacuum tubing. Tubing 16 is typically vertical and securely attached to beam 17 or other building or equipment structure. Tubing 16 is connected to vacuum source 22 by system elbow 18 and tubing 20.

Figure 2:
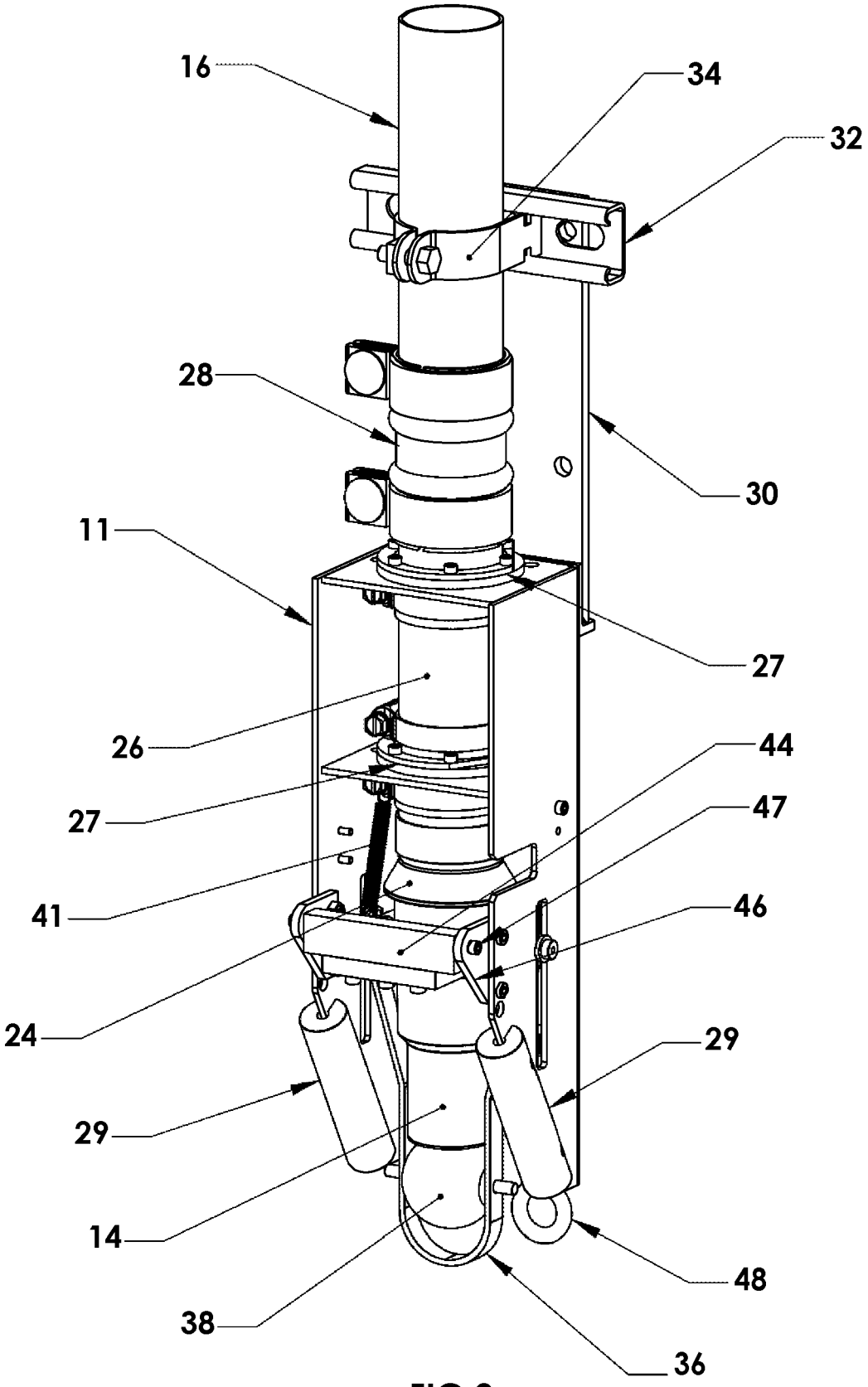
FIG. 2 is an enlarged view of vacuum valve assembly 10 mounted to a system vacuum tube suspended from the ceiling or other structure and with the hose in the fully retracted and stored position.
Figure 3:
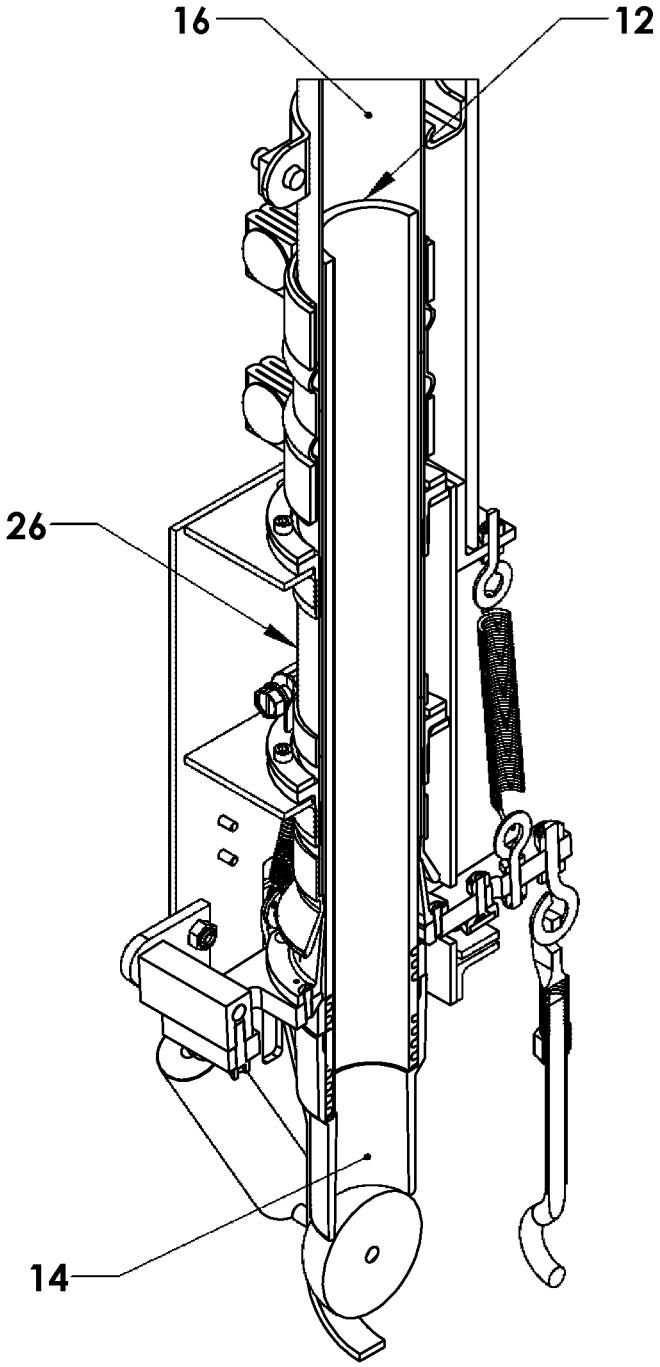
FIG. 3 is a 3-D cross sectional view along the centerline of valve assembly 10. The hose is shown in the retracted and stored position. The chuck and collet assembly are in the locked and sealed position. The hose end cuff is seated on the beveled recess of the pivot arm assembly forming a seal and the ball end seal is held against the hose end cuff by the spring loaded yoke sealing the ID of the hose.

As shown in FIG. 2, vacuum tube 16 is connected to retractor valve port tube 26 by coupling 28. Port tube 26 is connected to valve housing 11 by compression couplers 27. Housing 11 is connected directly to tube 16 by connector plate 30, strut 32 and tube clamp 34.

Vacuum hose 12 is stored in valve assembly 10, vacuum tubing 16, 18 and 20 when not in use. When in use hose 12 is extracted from valve assembly 10 to a length required for the task. However the end of the hose must remain in the retractor valve to stay connected to vacuum source 22. A variety of cleaning tools may be attached to hose end cuff 14 after hose 12 is extracted.

System Operation

The retracted hose 12 is stored in valve assembly 10 and system vacuum tubing 16. The length of system vacuum tubing that houses the retracted hose is called the hose track. Any turn in the hose track must be equipped with a large radius elbow 18 as shown in FIG. 1 to allow the hose to travel around the turn without binding.

Figure 4:
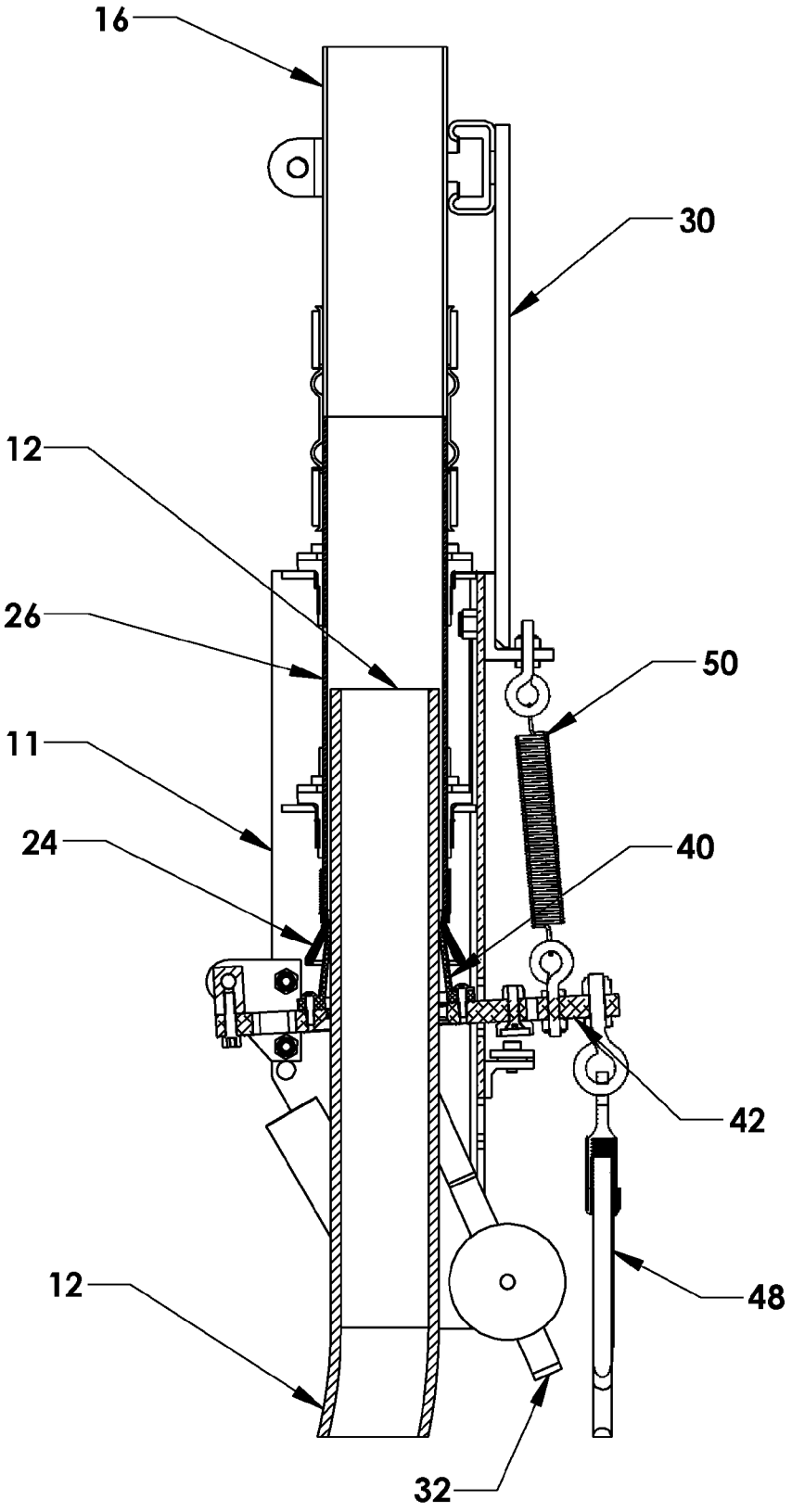
FIG. 4 is a planar cross sectional view along the centerline of valve assembly 10. The ball end seal has been removed from the hose cuff and the yoke assembly rotated toward the back of the valve making room for the extended hose. The hose is shown in an extracted position. The chuck and collet assembly is in the locked and sealed position.

For system operation the vacuum hose 12 is extracted from storage by pulling down and pushing back on spring loaded ball seal yoke 36 to remove the ball seal 38 from the end of the hose end cuff 14 as shown in FIG. 4. Releasing the ball seal yoke permits it to move upwards by return spring 41, FIG. 2, behind hose end cuff 14 and out of the way of the hose as shown in FIG. 4.

Figure 6:
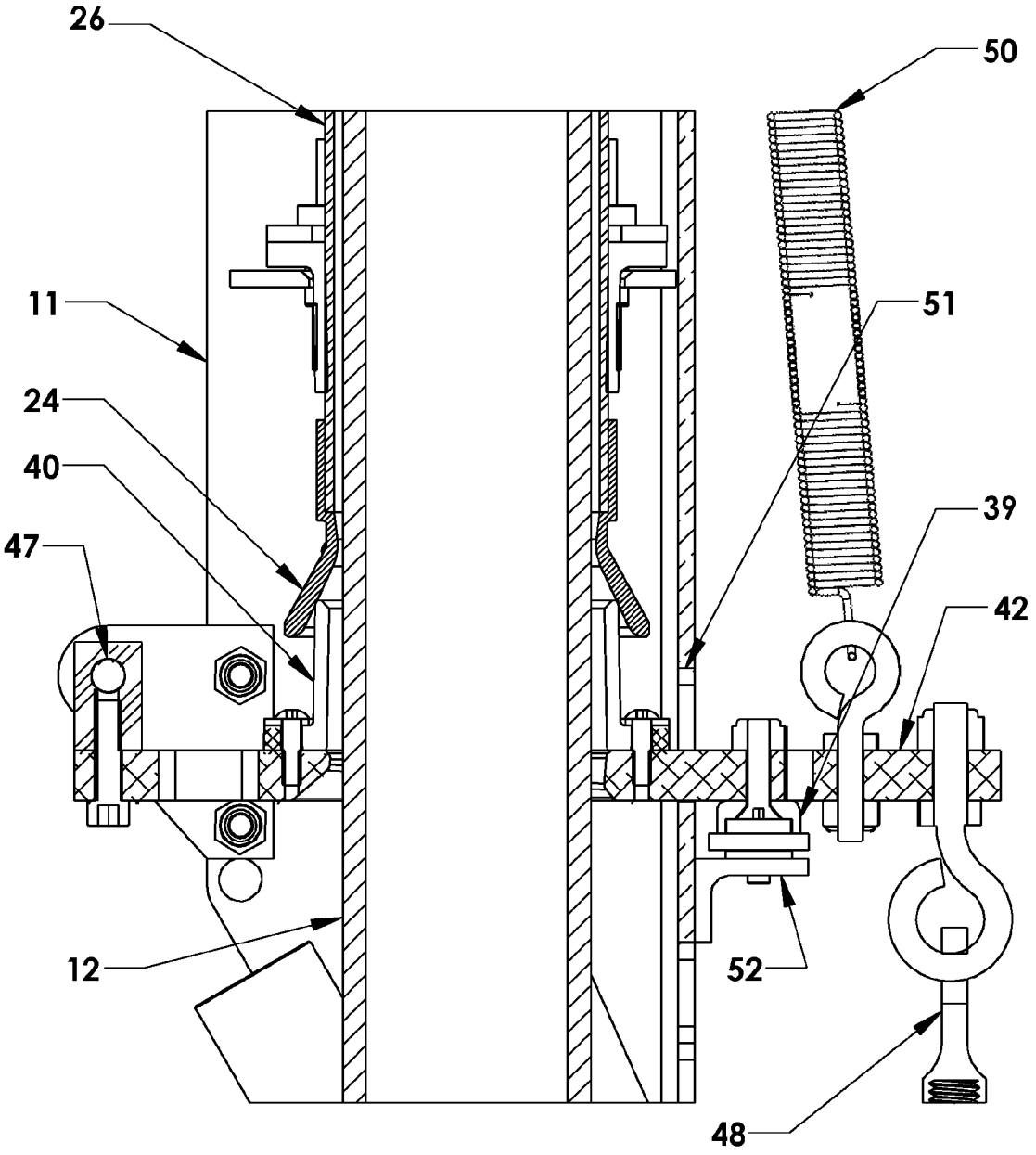
FIG. 6 is an enlarged partial section view through valve assembly 10 showing the chuck and collet assembly with the hose in the unlocked and unsealed position.
Figure 7:
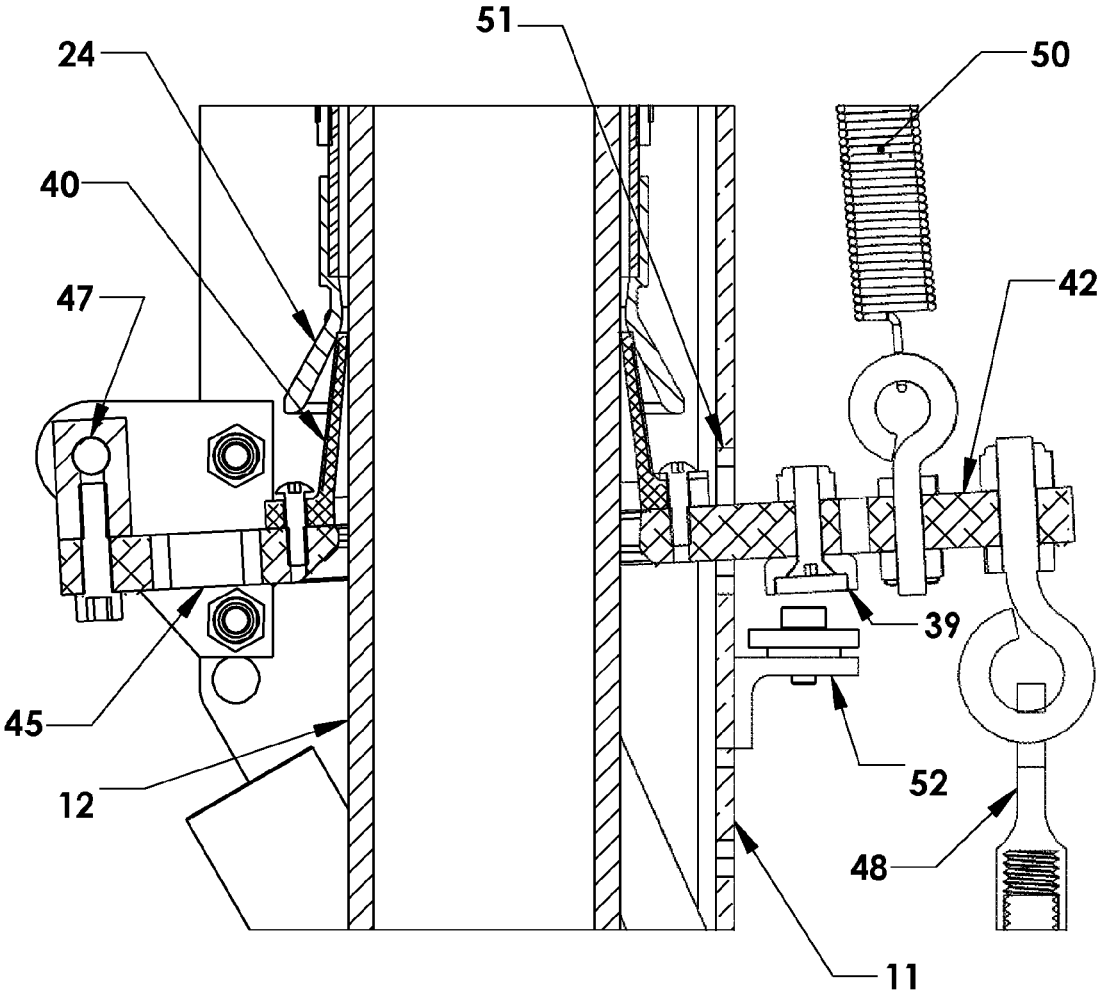
FIG. 7 is an enlarged partial section view through valve assembly 10 showing the chuck and collet assembly with the hose in the locked and sealed position.

The operator then pulls the actuator 48 which releases hose 12. In a preferred embodiment, as shown in FIG. 6, the actuator 48 is pulled until magnetic latch 39 mounted on pivot arm 42 engages striker plate 52. The hose 12 is now released. The unlocked and unsealed position of the chuck and collet assembly is shown in FIG. 6. He then grasps hose cuff 14 and pulls out the hose. Hose guides 29 prevent chaffing of the hose during extraction, retraction, and while being used. When the desired length of hose is extracted, the operator pushes on actuator 48, releasing magnetic latch 39 and allowing the spring loaded pivot arm 42 to move up or toward the compression cylinder or chuck. The elastomeric cylinder or collet 40 thereby re-seats in tapered compression cylinder or chuck 24, relocking and resealing the hose. The locked and sealed position of the chuck and collet assembly is shown in FIG. 7. With the vacuum source 22 turned on the system is ready for use.

After ball yoke seal 36 has been moved out of the way hose 12 can also be extracted simply by pulling on hose end cuff 14. The angle of taper on chuck 24 is such that when a sufficient force is applied to the hose in the direction of extraction the friction forces between collet 40 and hose 12 will be reduced enough to allow hose 12 to slide through collet 40 and to be extracted without pulling of actuator 48. An angle of taper for the chuck is selected to insure a self-locking friction angle condition. This angle is a function of the coefficients of friction of the materials selected for the chuck, elastomeric collet, and hose.

This manner of hose extraction is a faster and more convenient way to extract hose 12 but results in increased wear on the collet and hose since return spring 50 is constantly forcing collet 40 into contact with hose 12 during the extraction process. The preferred extraction procedure is to first ensure that the hose lock and seal are released by pulling on the actuator until the magnetic latch assembly 39 engages striker plate assembly 52 securing the lock and seal in the unlocked position. The user extracts whatever length of hose is desired or required for the cleaning task and then pushes on actuator 48 to release the magnetic latch allowing return spring 50 to reengage the hose lock and seal. For convenience, additional hose length desired or required during use could then be obtained by simply pulling on the hose.

When the operator is finished with the cleaning task hose 12 is retracted by first pulling on actuator 48 until magnetic latch 39 engages striker plate 52, unlocking and unsealing the hose. The system vacuum then draws the hose back through the retractor valve and into the system tubing 16 for storage. The rate of retraction can be increased by the operator placing a hand over hose end cuff 14 and restricting the air flow to increase suction force.

When the hose is fully retracted the operator then pushes on actuator 48 releasing magnetic latching assembly 39.

Return spring 50 rotates the pivot arm assembly 45 forcing the chuck and collet assembly into the locked and sealed position. The operator then grasps yoke assembly 36 pulling down and rotating it toward the front of the valve assembly and placing ball 38 over hose end cuff 14. Once ball 38 is placed over cuff 14 the system is sealed. The hose is now in the stored position as shown in FIG. 2. The vacuum source may be turned off or left on depending on the application.

Hose Lock and Seal Mechanism

The hose lock and seal consist of two main components. One is tapered chuck 24. The small inner diameter is slightly larger than the hose outer diameter to allow free passage of the hose when in the unlocked and unsealed condition but small enough to compress the collet around the hose when in the locked and sealed condition. In preferred embodiments, the small inner diameter is 0.04" to 0.08" larger than the hose outer diameter, and in a more preferred embodiment, the small inner diameter is 0.063" larger than the hose outer diameter. The large inner diameter is sized to receive the uncompressed outer diameter of the elastomeric collet and guide it into the chuck taper when moving from the unlocked and unsealed position to the locked and sealed position. In preferred embodiments, the large inner diameter is 0.4" to 0.8" larger than the hose outer diameter, and in a more preferred embodiment, the larger inner diameter is 0.56" larger than the hose outer diameter. The actual size dimensions of the above diameters will vary with the size dimensions of the hose lock and seal as well as the materials chosen for the hose lock and seal. The small end of the chuck is oriented towards the system vacuum tubing 16 and the large end toward the operator. The chuck is typically mounted on the inlet end of tubing 26. See FIG. 6 and FIG. 7.

The second component is elastomeric collet 40 which encircles hose 12 and slides into the large end of chuck 24. In the unlocked position, there is a gap between the hose and the collet large enough to allow the hose to pass through freely when in the unlocked and unsealed position. In preferred embodiments, the gap will be 0.1" to 0.3", with a more preferred embodiment having a gap of 0.16". As the collet is forced into the tapered chuck it compresses around hose 12 locking it in place and forming a vacuum seal around the hose outer diameter. Preferably, the collet material is softer than the hose material and conforms to any irregularities on the hose outer diameter, increasing the sealing action. See FIG. 6 and FIG. 7.

The angle of taper on chuck 24 is such that the friction forces between collet 40 and hose 12 and between collet 40 and chuck 24 are self-locking. Once the collet firmly contacts the hose outer diameter any vacuum force exerted on the hose to move it in the direction of the small end of the collet increases the locking and sealing action. Thus the chuck and collet are self-locking and form a vacuum assisted lock and seal around the hose.

PREFERRED EMBODIMENT

Figure 5:
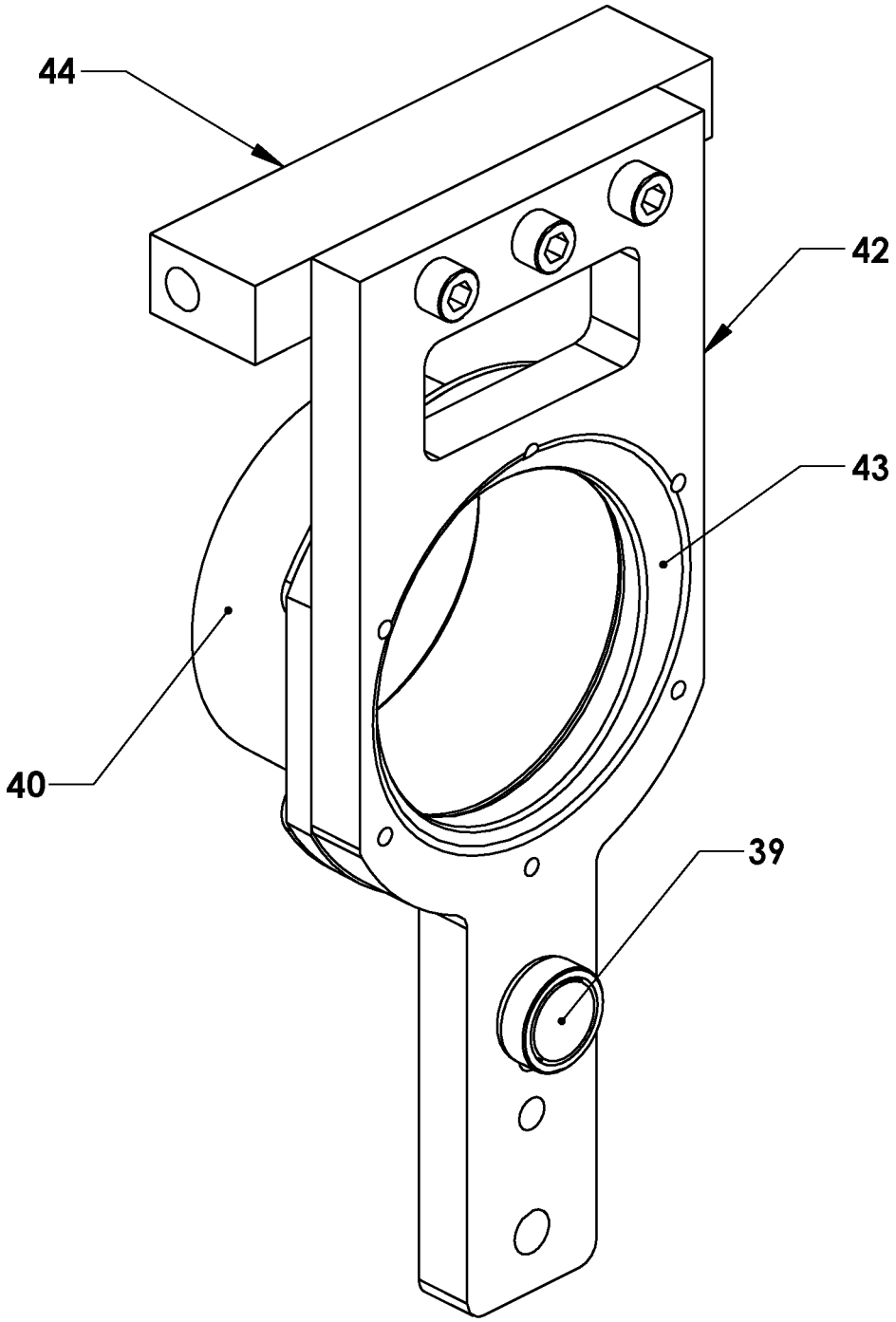
FIG. 5 is an enlarged view of the pivot assembly showing the elastomeric collet, pivot arm, pivot block, and latching magnet assembly.

In a preferred embodiment collet 40 is mounted on pivot arm 42 as shown in FIG. 5. Pivot arm assembly 45 pivots about shaft 47 which passes through pivot block 44 as shown in FIG. 2. This allows collet 40 to move in a near linear motion for a short distance along the path of rotation. The rotation of pivot arm 42 is limited between two stops, 51 and striker plate 52 as shown in FIG. 6. When the pivot arm is rotated to forward stop 52 collet 40 is pulled out of tapered chuck 24 and becomes perpendicular to and centered on the axis of hose 12 travel through the retractor valve assembly as shown in FIG. 6. This unlocks and unseals the collet from around the hose providing maximum clearance between the hose outer diameter and collet inner diameter during extraction or retraction of the hose.

When the required length of hose 12 has been extracted the operator pushes on actuator 48 releasing magnetic latch 39. Return spring 50 rotates pivot arm assembly 45 towards stop 51. This action forces collet 40 into tapered chuck 24 and compresses it around hose 12 as shown in FIG. 7. The travel of the pivot arm is usually stopped by the locking action of the collet and chuck and typically does not contact the rear stop 51. This locks hose 12 in position and forms a vacuum seal around the outer diameter.

While the preferred embodiment shows collet 40 mounted on a pivot arm other embodiments include mounting the collet on a support that slides back and forth along the center line of the hose path through the valve housing by means of an actuator and return spring. In another embodiment collet 40 could be mounted on a support that pivots or is moved back and forth by means of turning a threaded device. In a further embodiment, collet 40 could be mounted on flexures or flat springs that deflect.

The preferred embodiment is shown in an open housing suitable for mounting in a factory, shop or warehouse environment with exposed vacuum tubing. Other embodiments could be in a closed and sealed housing suitable for mounting in a wall cavity and connected to tubing located inside the wall cavity.

While FIG. 1 shows a single valve assembly 10 connected to vacuum source a plurality of valve assemblies each with its own hose and hose track may be connected to vacuum source 22.

The design of the hose seal and lock depicted in this invention combine several functions into one mechanism. Separate devices or mechanisms, manually or power operated, could be used for each function. For example, as shown above, the actuator is manually operated, but could be power operated. Without any specific limitation, in this scenario a switch or series of switches could be used to operate a powered actuator to move it between the open position and closed, sealed position and vice versa. Other devices or mechanisms could be alternatively used throughout the foregoing to achieve the functions and results as described.

The drawings and specifications have set forth preferred embodiments. Although specific terms are employed they are used in a descriptive sense and not for the purpose of limitation.

In the drawings and specifications there have been set forth preferred embodiments of the invention and although specific terms are employed, they are used in a generic and descriptive sense only and not for purposes of limitation. The design of the hose seal and restraint depicted in this invention combine several functions, that of sealing, restraining and wear reduction, into one device or mechanism. Separate devices or mechanisms could be used for each function. Other devices or mechanisms could be used to achieve the functions and results.

In addition, whereas the drawings and specifications relate to central vacuum cleaning systems for a home or building, the application is not limited to this industry alone but to any industry or operation where a vacuum system is used.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A hose retractor valve for a central vacuum cleaning system having a retractable suction hose that retracts into a system vacuum tubing, the hose retractor valve comprising:

a valve housing having an interior, and a connection port tube arranged to communicate with the system vacuum tubing and the valve housing interior;

a hose lock and seal assembly secured to the valve housing and connection port tube, the hose lock and seal assembly part of a pathway for receiving and guiding a retractable hose that extends through the valve housing interior, through the hose lock and seal assembly, through the connection port tube, and into the system vacuum tubing, the hose lock and seal assembly comprising:

a tapered compression cylinder having a small inner diameter that is slightly larger than the hose outer diameter and a large inner diameter that is larger than the hose outer diameter, with the small inner diameter oriented toward the vacuum tubing;

an elastomeric cylinder which encircles the hose and slides into the tapered compression cylinder, wherein the small inner diameter of the tapered compression cylinder allows free passage of the hose through the elastomeric cylinder in a first unlocked non-compressing position and compresses the elastomeric cylinder around the hose in a second locked compressing position, wherein the large inner diameter of the tapered compression cylinder is sized to receive the elastomeric cylinder from a first unlocked non-compressing position and guide the elastomeric cylinder into the tapered compression cylinder when moving into the second locked compressing position, and a thrust mechanism engageable with the elastomeric cylinder to impose a thrusting force onto the elastomeric cylinder to slide the elastomeric cylinder into the tapered compression cylinder, the thrust mechanism being moveable to move the elastic cylinder from a first unlocked non-compressing position to a second locked compressing position in which the elastomeric cylinder is forced into the tapered compression cylinder to cause the elastomeric cylinder to compress inward around the hose to form a seal around the hose.

2. The hose retractor valve of claim 1, in which the tapered compression cylinder of the hose lock and seal assembly is attached to the connection tube port at the small inner diameter portion of the tapered compression cylinder.

3. The hose retractor valve of claim 1, in which the hose lock and seal assembly further comprises a latch used to hold the thrusting mechanism and elastic cylinder in the first unlocked non-compressing position.

4. The hose retractor valve of claim 1, in which the elastomeric cylinder of the hose lock and seal assembly is mounted on a pivot arm that provides the thrusting mechanism.

5. The hose retractor valve of claim 4, in which the pivot arm of the hose lock and seal assembly is attached to an actuator and a return spring, in which the actuator is used to move the pivot arm to the first unlocked non-compressing position and the return spring is used in combination with the actuator to move the pivot arm to the second locked compressing position.

6. The hose retractor valve of claim 5, in which the hose lock and seal assembly further comprises a latch to hold the pivot arm in the first unlocked non-compressing position.

7. The hose retractor valve of claim 6, in which the latch of the hose lock and seal assembly is a magnetic latching assembly.

8. The hose retractor valve of claim 5, in which the return spring and pivot arm of the hose lock and seal assembly act in concert with a vacuum from a vacuum source to impose the thrusting force on the elastomeric cylinder.

9. The hose retractor valve of claim 5, in which the hose lock and seal assembly further comprises a first stop and second stop for the pivot arm, in which the first stop limits rotation of the pivot arm to the first unlocked non-compressing position and the second stop limits rotation of the pivot arm to a maximum second locked compressing position, in which the elastomeric cylinder has been slid into the tapered compression cylinder to an extent of maximum travel into the tapered compression cylinder.

10. The hose retractor valve of claim 5, in which the tapered compression cylinder of the hose lock and seal assembly is a chuck and the elastomeric cylinder of the hose lock and seal assembly is a collet.

11. The hose retractor valve of claim 10, in which the coefficient of friction between the chuck and collet of the hose lock and seal assembly is such that when a sufficient force is applied to the hose in a direction of extraction the friction forces will be reduced enough to allow the hose to slide through the collet and be extracted without use of the actuator.

12. The hose retractor valve of claim 1, in which the elastomeric cylinder of the hose lock and seal assembly is mounted on a threaded support that provides the thrusting mechanism.

13. The hose retractor valve of claim 1, in which the elastomeric cylinder of the hose lock and seal assembly is mounted on a deflection support that provides the thrusting mechanism.

14. The hose retractor valve of claim 1, in which the elastomeric cylinder of the hose lock and seal assembly is made of a material that is softer than the hose material.

15. The hose retractor valve of claim 1, in which the hose retractor valve is mounted overhead at about an industry standard head height clearance.

16. The hose retractor valve of claim 5, in which the actuator is a manually operated actuator.

17. The hose retractor valve of claim 5, in which the actuator is a power operated actuator.

18. The hose retractor valve of claim 1, in which the small inner diameter of the tapered compression cylinder of the hose lock and seal assembly is 0.04 inches to 0.08 inches larger than the hose outer diameter and the large inner diameter of the tapered compression cylinder is 0.4 inches to 0.8 inches larger than the hose outer diameter.

19. A hose retractor valve assembly for a retractable hose vacuum cleaning system, the hose retractor valve assembly comprising:

a valve housing;

a retractor valve port tube communicating between a vacuum tubing and the valve housing;

a tapered compression cylinder on the retractor valve port tube end that is in communication with the valve housing;

an elastomeric cylinder;

a pivot arm to which the elastomeric cylinder is mounted;

a return spring to which the pivot arm is attached; and an actuator to which the pivot arm is attached.

20. The hose retractor valve assembly of claim 19, further comprising a latch assembly to latch the pivot arm in an unlocked position in which the elastomeric cylinder is not compressed.

* * * * *